United States Patent [19]

Curry

[11] 4,171,652

[45] Oct. 23, 1979

[54] CHAIN WRENCH

[76] Inventor: John B. Curry, 4710 45th, Lubbock, Tex. 79414

[21] Appl. No.: 900,773

[22] Filed: Apr. 28, 1978

[51] Int. Cl.[2] ..... B25B 13/52

[52] U.S. Cl. ..... 81/66 R; 81/3.43

[58] Field of Search ..... 81/64–68, 81/3.43, 69–70

[56] References Cited

U.S. PATENT DOCUMENTS

| | | | |
|---|---|---|---|
| 1,279,441 | 9/1918 | Relyea | 81/3.43 |
| 2,081,383 | 5/1937 | Rector | 81/3.43 |
| 2,473,425 | 6/1949 | Grant | 81/3.43 |
| 3,678,788 | 7/1972 | Maffi | 81/3.43 |

*Primary Examiner*—James L. Jones, Jr.
*Attorney, Agent, or Firm*—Wendell Coffee

[57] ABSTRACT

This device is a chain wrench for loosening and tightening screw thread engaging items from base members. It consists of a thin handle whose length is approximately six times its width. Chain links are permanently attached to the handle forming a closed loop. The chain links are made of a bicycle-like chain which has no flexibility in a lateral direction.

16 Claims, 7 Drawing Figures

CHAIN WRENCH

BACKGROUND OF THE INVENTION:

1. Field of the Invention

This invention relates to link tools, and more particularly to tools used for loosening and tightening screw thread engaging items from base members.

2. Description of the Prior Art

Mechanical devices for rendering a power advantage to someone loosening or tightening a screw thread engaging item have long been known to the art. Various tools have been previously disclosed to accompish the function.

Before this invention was filed, an independent search was made and the following U.S. Patents were produced: U.S. Pat. Nos. Bosinski, 257,344; Stull, 733,298; Braunschweiger, 784,467; Self, 2,131,643; Gavlak, 2,257,460; Yohe, 3,230,800; Hofheins, 3,293,957; Coblitz, 3,387,513.

HOPKINS discloses a jar opener to be placed on a wall. It uses a chain with the two ends of the chain positioned at the same point. It is adaptable for large and small jars.

KOSINSKI discloses a chain wrench with eight links in the chain. The chain has one end attached to the end of the handle and the other end of the chain attached to and spaced from the end of the handle. It appears that one of the end links E can extend over the leading edge of the handle such that the handle comes in contact with the item to be loosened or tightened.

STULL and BRAUNSCHWEIGER disclose jar openers which use a stiff wire in lieu of a flexible chain.

YOHE discloses a wrench device with chain links. One end of the chain is permanently affixed to the handle, and the other is detachable.

The other patents appear less pertinent to this invention than those discussed.

SUMMARY OF THE INVENTION

New and Different Function

I have solved the problem of creating a chain wrench which may be used on many different sizes of screw thread engaging items such as automobile oil filters, large or small lids on jars containing food. The engagement of these items may be accomplished without a manipulation or changing the chain ends. Thus, this invention can be used quickly and safely without fear that a chain end will become a flying hazard since both ends of the chain are permanently fastened to the wrench handle. Thus, the total function of the invention is greater than the sum of the function of the handles, chain links, etc.

OBJECTS OF THE INVENTION

An object of this invention is to loosen and tighten a screw thread engaging item from a base member.

Another object is to provide a chain wrench which is adaptable to accommodating a wide variety of screw thread items without any manipulation of the chain ends.

Further objects are to achieve the above with a device that is sturdy, compact, durable, lightweight, simple, safe, efficient, versatile, ecologically compatible, energy conserving, and reliable, yet inexpensive and easy to manufacture, adjust, operate and maintain.

The specific nature of the invention, as well as other objects, uses, and advantages thereof, will clearly appear from the following description and from the accompanying drawing, the different views of which are not scale drawings.

DESCRIPTION OF THE PREFERRED EMBODIMENT

Figures 1, 2, 3, 4, 5, 6, 7:
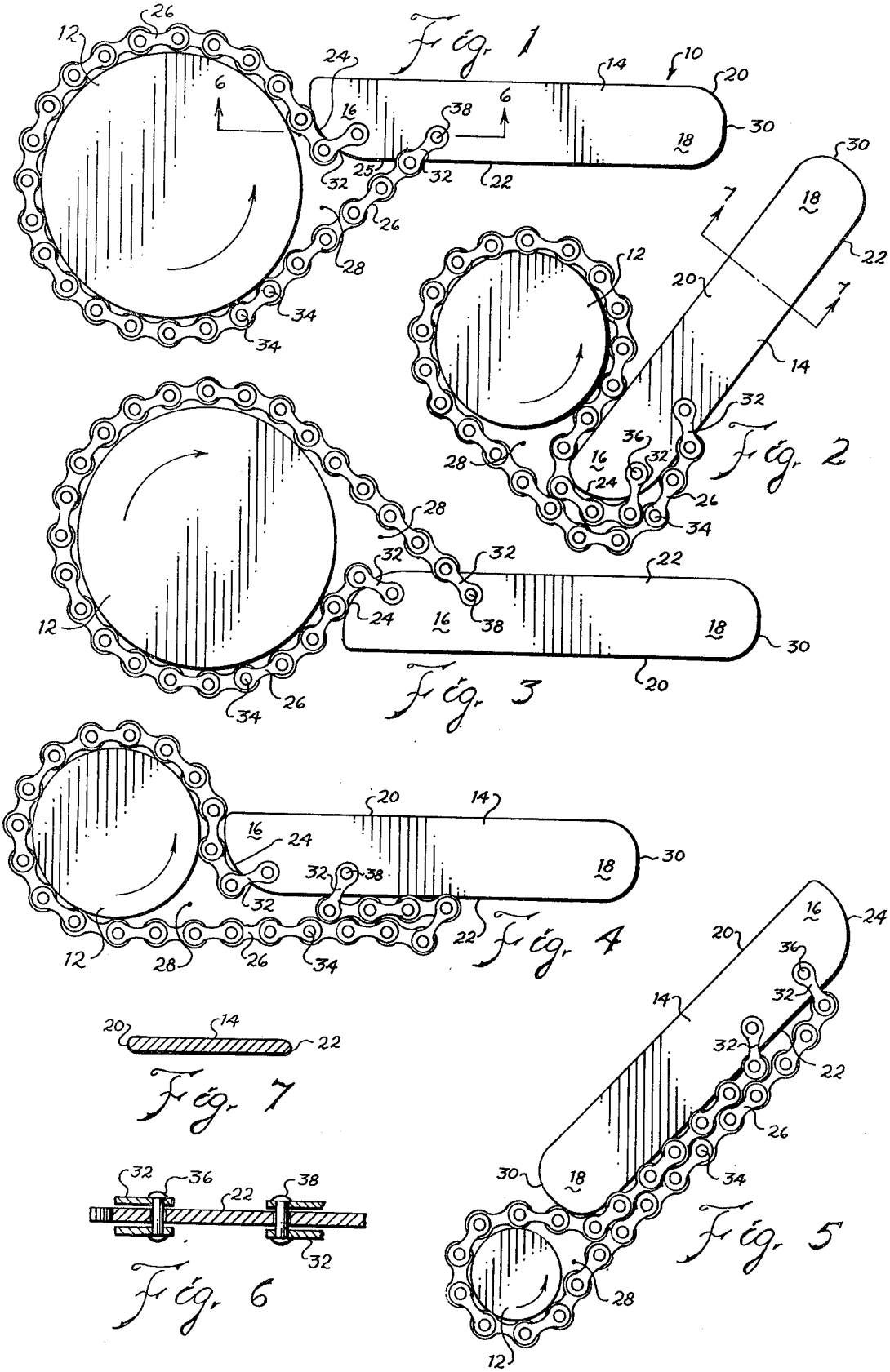
FIG. 1 is a top plan view of my invention engaged around a member with large diameter. The arrow shows direction for loosening.
FIG. 2 is similar to FIG. 1, but shows an item with a smaller diameter and a different loosening configuration of my invention.
FIG. 3 is similar to FIG. 1, but shows my invention in the tightening configuration.
FIG. 4 is similar to FIG. 2, but shows my invention in a different loosening configuration.
FIG. 5 is a top plan view of my invention in a loosening configuration and engaged around a member with a small diameter.
FIG. 6 is a sectional view taken on line 6—6 of FIG. 1 showing the chain ends fastened to the handle.
FIG. 7 is a section view taken on line 7—7 of FIG. 2 showing the rounded edges of the handle.

Chain wrench 10, according to my invention, is shown in FIG. 1 affixed to screw thread engaging item 12. The wrench 10 has handle 14 which includes working end 16, handle end 18, top edge 20 and bottom edge 22. Curved face 24, a circular arc joins the top edge 20 and bottom edge 22 at the working end 16 of the handle 14. The curved face 24 is tangent to the bottom edge 22 at point 25 and is about normal to the top edge 20 at the intersection of the curved face 24 and the top edge 20.

Wrench 10 also has a chain formed of links 26. The chain has a first end pivoted to the handle 14 near the point of tangency 25. The other end of the chain is pivoted to the handle a short distance therefrom, thereby forming closed loop 28 in the links. The closed loop 28 has end links 32. The handle 14 also has rounded end 30 which joins the top edge 20 to the bottom edge 22 at the handle end 18 of the handle 14.

Handle 14 is made of metal plate and is approximately 5.5 inches (14 cm) long, 1 inch (2.5 cm) wide and ⅛" (3 mm) in thickness. Therefore, it may be seen that the length of the handle is about six times the width. The width of the handle is about eight times the thickness. Also, the short distance between the ends of the chain on the handle is one inch, which is to say equal to the width of the handle. These dimensions may vary, but as indicated, they provide a handle that is lightweight, yet easily manageable, portable and sturdy. Additionally, the top edge 20, bottom edge 22 and rounded end 30 are rounded and smooth to the hand so that there is no discomfort to the hand while the wrench 10 is in use.

The closed loop 28 consists of twenty-seven chain links 26. Each link 26 is approximately ½" (1.3 cm), which is about half the width of the handle, from the center of one pivot 34 to the next. The end links 32 are permanently affixed to the working end 16 of the handle 14 approximately 1" apart, and are affixed approximately 3/16ths of an inch (4 mm) which is about a third the length of each link, from the bottom edge 22 and in such a manner that the end link 32 closest to curved face 24 extends to reach curved face 24 over a portion of its length, but can never extend along curved face 24 to reach top edge 20 of the handle 14. It may be seen, particularly in FIG. 6, the first end of the chain that is near the point of tangency 25 is attached to the handle by first rivet 36 through the thickness of the handle and the other end of the chain which is one handle width away is attached to the handle by rivet 38 also through the thickness of the handle. The rivets permanently fix the chain to the handle in a manner that the chain may pivot as illustrated and described.

Curved face 24 becomes a fulcrum for the lever action of the handle 14 as the closed loop 28 is tightened around the screw thread engaging item 12 that is to be loosened or tightened. After the links 26 are tightened around the item 12, pressure is applied in the direction for either loosening (FIG. 1) or tightening (FIG. 3).

Wrench 10 may be used to loosen and tighten screw thread engaging items 12 with diameters up to four inches. With these larger diameter items, as in FIGS. 1 and 3, there is no doubling back of the chain against itself. However, with the smaller diameter items, as in FIGS. 2, 4 and 5, several chain links are required to be doubled back against themselves in order to achieve the power advantage from the wrench 10. However, it should be noted that at no time does any surface of handle 14 come in contact with the item 12 that is to be loosened or tightened. Additionally, it should be noted that either the handle end 18 or working end 16 of the handle 14 can become the fulcrum for the lever action of the handle 14. FIG. 5 illustrates the handle end 18 being used as the fulcrum point.

Also it may be seen that the chain is a "bicycle chain", i.e., although the chain is quite flexible along its working face, it has no flexibility in a lateral direction. This is important if the chain is to be doubled back upon itself as seen in FIGS. 2, 4 and 5. It will be appreciated by having a large number of links that the wrench is readily adaptable to be used on as large an item 12 as for example four inches (10 cm) or as small an item 12 of about 2 cm.

As an aid to correlating the terms of the claims to the exemplary drawing, the following catalog of elements is provided:

10: chain wrench, 26: chain links, 12: screw thread engaging item, 28: closed loop, 14: handle, 30: rounded end, 16: working end, 32: end link, 18: handle end, 34: pivot, 20: top edge, 36: first rivet, 22: bottom edge, 38: other rivet, 24: curved face.

The embodiment shown and described above is only exemplary. I do not claim to have invented all the parts, elements or steps described. Various modifications can be made in the construction, material, arrangement, and operation, and still be within the scope of my invention. The limits of the invention and the bounds of the patent protection are measured by and defined in the following claims. The restrictive description and drawing of the specific example above do not point out what an infringement of this patent would be, but are to enable the reader to make and use the invention.

SUBJECT MATTER CLAIMED FOR PROTECTION

I claim as my invention:

1. A chain wrench for loosening and tightening a screw thread engaging item from a base member comprising:
   a. a handle having
      (i) a working end,
      (ii) a handle end,
      (iii) a top edge, and
      (iv) a bottom edge, and
      (v) formed of metal plate,
   b. a curved face joining the top edge to the bottom edge at the working end of the handle,
   c. said curved face about tangent to the bottom edge and normal to the top edge,
   d. a chain having a plurality of links,
      (i) a first end permanently pivoted by a rivet through the thickness of the handle near the point of tangency of the bottom edge and curved face, and
      (ii) the other end permanently pivoted by a rivet through the thickness of the handle at a point a short distance from the first and near the bottom edge, thereby forming a closed chain loop,
      (iii) the chain having no flexibility in a lateral direction,
   e. the end link of the first end of the chain extends to reach the curved face over a portion of its length, but can never extend along curved face to reach the top edge of the handle.

2. The invention as defined in claim 1 further comprising:
   g. a rounded face joining the top edge to the bottom edge at the handle end of the handle and,
   h. the top edge and bottom edge are rounded and smooth to the hand.

3. The invention as defined in claim 1 wherein the handle is about eight times as wide as it is thick.

4. The invention as defined in claim 1 wherein the handle is about six times as long as it is wide.

5. The invention as defined in claim 1 wherein the handle is about 1 inch (2.5 cm) in width.

6. The invention as defined in claim 1 wherein the closed chain loop consists of 27 links.

7. The invention as defined in claim 1 wherein the handle is about twice as wide as the length from pivot to pivot of each link in the chain.

8. The invention as defined in claim 1 further comprising the short distance between the ends of the chain is about equal to the width of the handle.

9. The invention as defined in claim 1 wherein the chain links are pivoted to the handle about one-third their length from the bottom edge.

10. The invention as defined in claim 9 further comprising the short distance between the ends of the chain is about equal to the width of the handle.

11. The invention as defined in claim 10 wherein the handle is about twice as wide as the length from pivot to pivot of each link in the chain.

12. The invention as defined in claim 11 wherein the closed chain loop consists of 27 links.

13. The invention as defined in claim 12 wherein the handle is about 1 inch (2.5 cm) in width.

14. The invention as defined in claim 13 wherein the handle is about six times as long as it is wide.

15. The invention as defined in claim 14 wherein the handle is about eight times as wide as it is thick.

16. The invention as defined in claim 15 further comprising:
   g. a rounded face joining the top edge to the bottom edge at the handle end of the handle, and
   h. the top edge and bottom edge are rounded and smooth to the hand.

* * * * *